United States Patent [19]

Buzzell

[11] 4,190,418

[45] Feb. 26, 1980

[54] APPARATUS AND METHOD FOR PREPARING GRADIENT DYED SHEET

[75] Inventor: Harold O. Buzzell, Wollaston, Mass.

[73] Assignee: Polaroid Corporation, Cambridge, Mass.

[21] Appl. No.: 756,355

[22] Filed: Jan. 3, 1977

Related U.S. Application Data

[63] Continuation-in-part of Ser. No. 649,049, Jan. 14, 1976, abandoned.

[51] Int. Cl.[2] ..... D06P 7/00

[52] U.S. Cl. ..... 8/4; 264/1

[58] Field of Search ..... 8/4

[56] References Cited

U.S. PATENT DOCUMENTS

| | | | |
|---|---|---|---|
| 1,943,408 | 9/1952 | Zerk | 8/150 |
| 2,609,269 | 9/1952 | Ryan et al. | 8/4 |
| 3,993,435 | 11/1976 | Korver | 8/4 |

*Primary Examiner*—Donald Levy

*Attorney, Agent, or Firm*—Louis G. Xiarhos; Esther A. H. Hopkins

[57] ABSTRACT

A process and apparatus for dyeing a web in a continuous manner so as to impart a dye density gradient to the web across its transverse dimension is disclosed.

16 Claims, 3 Drawing Figures

APPARATUS AND METHOD FOR PREPARING GRADIENT DYED SHEET

BACKGROUND OF THE INVENTION

This application is a continuation-in-part of U.S. Application Ser. No. 649,049 filed Jan. 14, 1976 now abandoned.

This invention relates to methods and apparatus for applying dyes to webs so as to obtain a smoothly changing gradation in the amount of dye present on the web as a function of the distance from a specified edge.

There are currently commercially available glass lenses which have been dyed with a gradation in shade from a deep hue, generally at the top of a lens, vignetting to a very light hue as the dye area nears the bottom of the lens. The lenses for such sunglasses are usually prepared by dipping each lens slowly into a dye material and removing the lens so dipped. The result of this individual dipping is a differential dyeing as a function of the residence time of each lens in the dye solution, but the process is a slow and expensive one.

The object of this invention is to provide a means for the continuous production of a web material having a predetermined dye density gradient. The web may be cut into sunglass lenses after the dyeing process.

Another object is to provide the means for assuring a requisite differential residence time in the dye bath without introducing striations which mark the limit of dye contact.

A still further object is to provide apparatus useful in the continuous preparation of a web with a dye density gradient.

Other objects of the invention will in part be obvious and will in part appear hereinafter.

The invention accordingly comprises the method involving the several steps and the relation and order of one or more of such steps with respect to each of the others and the apparatus possessing the construction, combination of elements and arrangement of parts which are exemplified in the following detailed disclosure.

SUMMARY OF THE INVENTION

This invention is concerned with methods and apparatus for dyeing a web in a continuous manner so as to impart a dye density gradient to the web across the narrow, or transverse dimension of the web. The web so dyed may then be cut into lens blanks.

BRIEF DESCRIPTION OF THE DRAWINGS

For a fuller understanding of the nature and objects of the invention, reference should be had to the following detailed description taken in connection with the accompanying drawing wherein.

DESCRIPTION OF THE PREFERRED EMBODIMENTS

Figure 1:
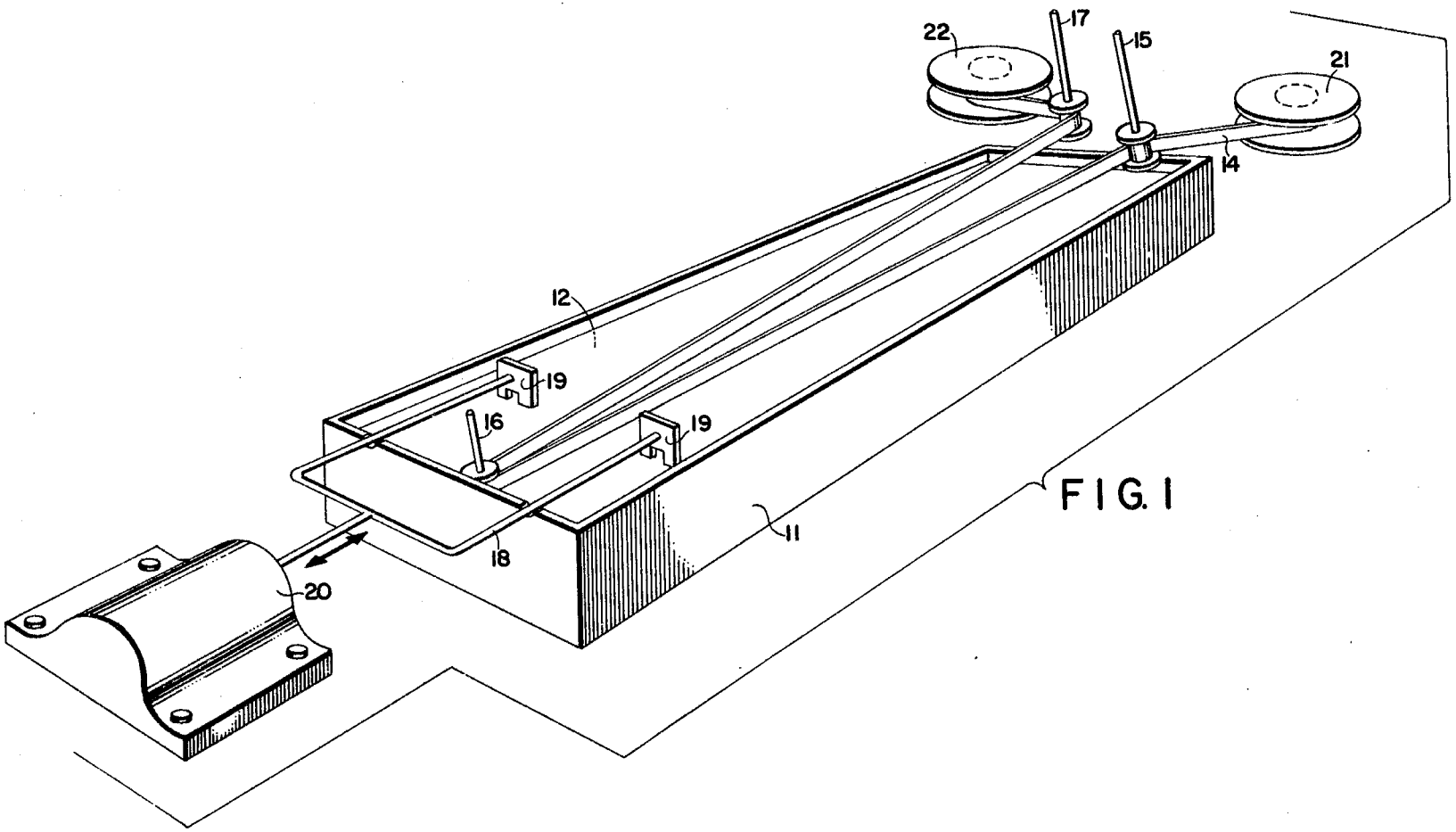
FIG. 1 is a perspective view of an apparatus for providing a dye density gradient to a web in accordance with this invention.

Referring to FIG. 1, the apparatus of the instant invention, which generally comprises a dye bath container and associated web-transport equipment is depicted.

Dye bath container 11, which is adapted to retain dye bath 12, is associated with means for conducting a web 14 longitudinally into dye bath container 11, and progressively transversely submerging the web 14 into the dye bath 12, and conducting the web 14 out of dye bath 12. These conducting means generally comprise adjustable pulleys 15, 16 and 17. There is also shown means for producing waves on the surface of the dye bath. Such wave-producing means comprise a frame 18, paddles 19 attached to the frame 18, and means 20 attached to the frame 18 for moving the frame 18 and attached paddles 19 in a reciprocating manner. The dye bath container may be associated with heating means (not shown). The dye bath material itself comprises either a solution or dispersion of a dye which may be, for example, a water-soluble dye in a water solution, an organic solvent-soluble dye in, for example, an alcohol-water mixture, or preferably a water dispersible dye dispersed in water. A preferred dye is one which is absorbed by the web only at a temperature above about 180° F. which obviates the possibility of unintentionally staining the web by random spattering of cool dye onto the web. A preferred dye is the dispersion sold as a "catalytic dye" by Brainpower Inc. of Florida although other dispersions, such as the commercially available Rit dyes may be used.

The web 14 preferably comprises a continuous flexible sheet of material having a transverse, or widthwise dimension small relative to its longitudinal, or lengthwise dimension. The top and bottom edges are substantially parallel. In a preferred embodiment the transverse dimension may be, for example, approximately 5 to 10 cm while the longitudinal dimension, may be several hundred meters. Preferably this flexible web will comprise a transparent synthetic plastic material and will be initially provided on a supply spool 21, threaded through the conducting or transport means and onto the take-up spool 22.

Figure 2:
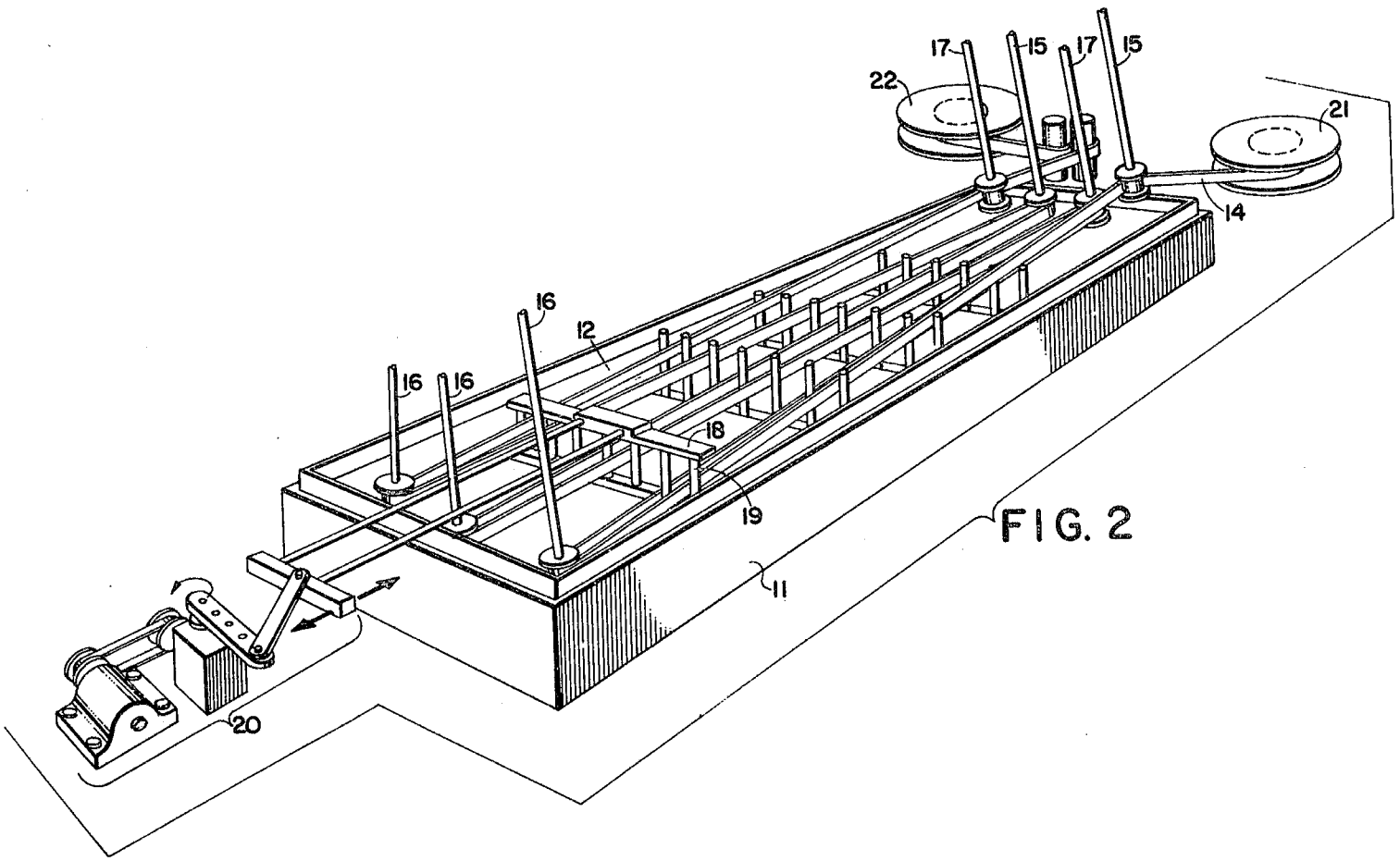
FIG. 2 is a perspective view of another embodiment of the apparatus of this invention.

FIG. 2 shows the preferred embodiment of the apparatus of the present invention wherein additional adjustable transport means conduct the web progressively transversely into and out of the dye bath three times before conducting the web onto the take-up spool 22. Obviously the intensity gradient of the dyeing may be controlled by precisely adjusting the residence times of progressive transverse points of the web in the dye bath.

In operation a spool containing a web of material to be dyed is fixed in a position adjacent the dye bath 12 such that a plane through longitudinal dimension of the web as it enters the dye bath is preferably substantially perpendicular to the surface of the bath and the top and bottom edges of the web are at a small acute angle to the surface of the dye bath. This orientation results in the bottom edge of the web being progressively immersed into the bath as the web proceeds from the spool and then progressively caused to emerge from the bath so that a differential transverse residence time is established for the web in the dye bath. This operation essentially comprises conducting the web progressively, transversely into the dye bath to a point of maximum submersion, then conducting the web out of the dye bath. Dye which adheres to, but is not absorbed by the web can be easily washed from the surface of the web before drying and winding.

Figure 3:
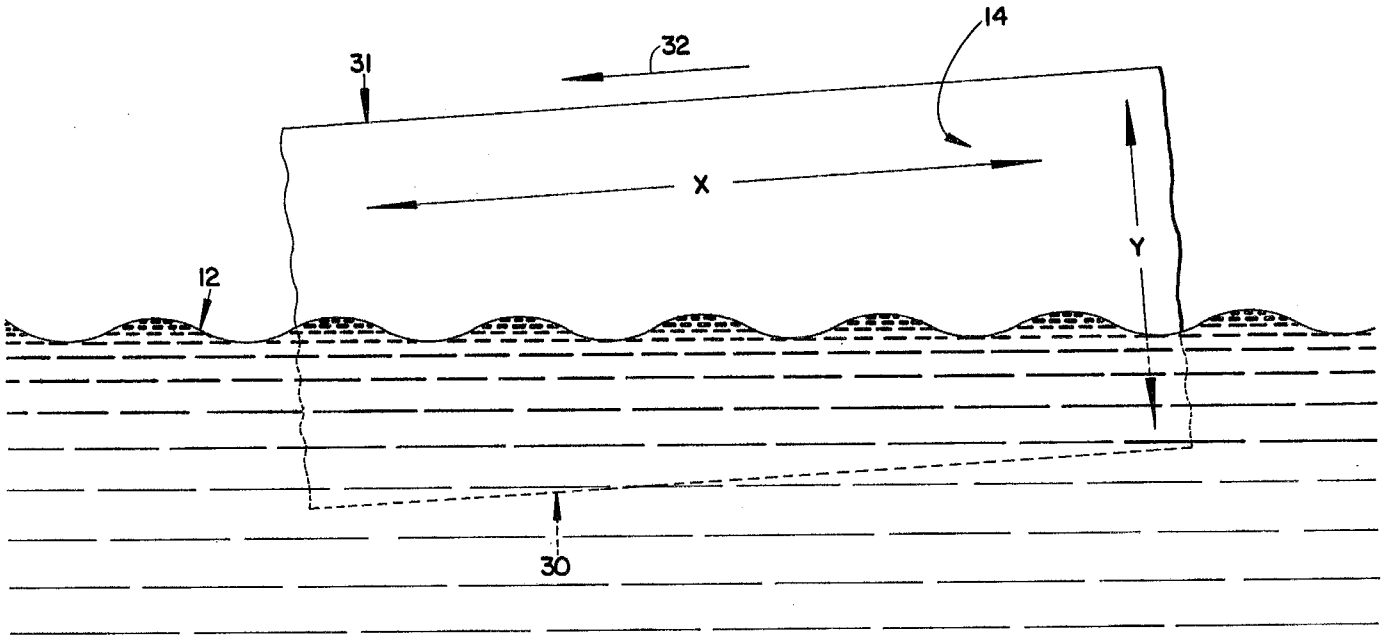
FIG. 3 is a side view of a section of the web as it enters the dye bath.

Referring to FIG. 3, there is depicted a side view of a section of web 14 entering dye bath 12 in the direction indicated by the arrow marked 32. The bottom edge 30 of the web enters the dye bath at an angle acute to the average surface of the dye bath. Top edge 31 is essentially parallel to bottom edge. It can be seen that those points on the web nearer the bottom edge have a longer residence time in the dye bath than do those points further away from the bottom edge, closer to the top edge. X and Y denote, respectively, the longitudinal and transverse dimensions of the web.

Preferably the dye bath will contain up to about 25% of a water miscible solvent having a low vapor pressure such as, for example, ethylene glycol, which will keep the dye from crystallizing on the surface of the web so that excess, unabsorbed dye may be washed off. A preferred concentration of ethylene glycol is approximately ten percent by volume.

The amount of dyeing at any point in the web is directly related to the time of exposure of that point to the dye bath material in the dye bath container, i.e., the residence time of that point in the bath. For a given transverse segment, those points exposed to the dye bath for a longer residence time, that is, those points first submerged into the dye bath and last removed from the dye bath, have a greater exposure to the dyeing material and have more dye absorbed than those points having a shorter residence time. The progression of points on a given transverse segment, starting at one edge of that segment and moving to the other edge with the residence time varying constantly from one point to the next will result in a dye density gradient on that transverse segment.

The web, after the dyeing, will then have excess liquid removed from its surfaces by, for example, a squegee. The dyed web may then be washed, dried and rolled in conventional manner.

As stated above the web may comprise a transparent synthetic plastic material such as oriented polyvinyl alcohol which is commonly used in the manufacture of sunglass lenses, though any suitable synthetic plastic web material may be used. The web of the preferred embodiment comprises a sheet of a plastic laminate comprising the following layers in sequence: a layer of polymerized polyethylene glycol dimethacrylate, a layer of cellulose acetate butyrate, a polarizing layer comprising an iodine-stained, molecularly oriented polyvinyl alcohol, a second layer of cellulose acetate butyrate and a second a second layer of polymerized polyethylene glycol dimethacrylate.

The washed, dried, dyed web may be cut into lens blanks so that the dye density gradient, which is transverse with respect to the web, runs from what may be designated as the top of a sunglass lens to the bottom of such a lens.

It is important in producing a dye density gradient on the web that a smooth gradient is obtained and therefore it is important that there be introduced no striations indicating an abrupt change in density. Such striations can be avoided by disturbing the surface of the dye bath, for example, by creating waves on the surface. These waves may be formed, for example, by paddles 19 attached to means for moving said paddles back and forth in the dye bath. Such means are shown in the figures as the frame 18 and means 20 for moving the frame in a reciprocating manner. The waves, so set up, introduce a constantly changing but random surface configuration and make possible the avoidance of formation of the striations which might be introduced and destroy the smooth gradient.

Since certain changes may be made in the above process and apparatus without departing from the scope of the invention herein involved, it is intended that all matter contained in the above description and shown in the accompanying drawings shall be interpreted as illustrative and not in a limiting sense.

What is claimed is:

1. A method of providing a dye density gradient to a web comprising a relatively small transverse dimension and top and bottom substantially parallel longitudinal edges, said web providing a lens stock from which lenses can be cut, which method comprises:

conducting said web into a bath of dye material in such a manner that the transverse plane through the longitudinal dimension of said web makes substantially a right angle with the plane of the surface of said bath and said bottom longitudinal edge of said web enters said dye bath at an acute angle to the surface of said dye bath so that the web is at least partially progressively immersed in said dye bath, and conducting said web out of said dye bath whereby a transverse dye density gradient is established on said web as a function of the residence time of the various portions of said web in said dye bath.

2. The method of claim 1 which further comprises agitating the surface of said dye bath while conducting said web into said dye bath.

3. The method of claim 1 wherein said dye bath is maintained at a temperature in the range of approximately 180° F. to just below the boiling point of said dye bath.

4. The method of claim 1 wherein said web comprises a transparent synthetic plastic material.

5. A method for providing a lens stock from which lenses can be cut comprising providing a web comprising a transparent synthetic plastic material, said web comprising a relatively large longitudinal dimension and a relatively small transverse dimension and top and bottom substantially parallel longitudinal edges, conducting said web into a bath of dye material in such a manner that the transverse plane through the longitudinal dimension of said web makes substantially a right angle with the plane of the surface of said bath and said bottom longitudinal edge of said web enters said dye bath at an acute angle to the surface of said dye bath so that the web is at least partially progressively immersed in said dye bath, conducting said web out of said dye bath, whereby a transverse dye density gradient is established on said web as a function of the residence time of the various portions of said web in said dye bath, washing said web after conducting it out of said dye bath, drying said web, and cutting lens blanks from said web.

6. The method of claim 4 wherein said dye bath comprises a water dispersible dye dispersed in water.

7. The method of claim 6 wherein said dye bath further comprises up to about 25% of a water miscible solvent having a low vapor pressure.

8. The method of claim 7 wherein said solvent is ethylene glycol.

9. A method of providing a dye density gradient to a web comprising a relatively large longitudinal dimension and a relatively small transverse dimension and top and bottom substantially parallel longitudinal edges, said web providing a lens stock from which lenses can be cut, which method comprises:

conducting said web into a bath of dye material containing about ten percent of a water miscible solvent having a low vapor pressure, and maintained at a temperature above approximately 180° F. but below the boiling point of said dye bath, in such a manner that the transverse plane through the longitudinal dimension of said web makes substantially a right angle with the plane of the surface of said bath and said bottom longitudinal edge of said web enters said dye bath at an acute angle to the surface of said dye bath, so that said web is at least partially immersed in said dye bath;

continually disturbing the surface of said dye bath; and conducting said web out of said dye bath;

whereby a transverse dye density gradient is established on said web as a function of the residence time of the various portions of said web in said dye bath.

10. The method of claim 9 wherein said web comprises a transparent synthetic plastic material.

11. The method of claim 10 wherein said transparent synthetic plastic material comprises a plastic laminate comprising a polarizing layer.

12. The method of claim 10 which further comprises the steps of conducting said web through means for removing excess liquid, washing said web with water, drying said web, and cutting from said web lens blanks having a dye density gradient.

13. The method of claim 1 wherein said substantial angle is a right angle.

14. A method for providing a lens stock from which lenses can be made comprising providing a web comprising a transparent synthetic plastic material, said web comprising a relatively large longitudinal dimension and a relatively small transverse dimension and top and bottom substantially parallel longitudinal edges, conducting said web into a bath of dye material in such a manner that the transverse plane through the longitudinal dimension of said web makes a right angle with the plane of the surface of said bath and said bottom longitudinal edge of said web enters said dye bath at an acute angle to the surface of said dye bath so that the web is at least partially progressively immersed in said dye bath, conducting said web out of said dye bath, whereby a transverse dye density gradient is established on said web as a function of the residence time of the various portions of said web in said dye bath, washing said web after conducting it out of said dye bath, drying said web, and cutting lens blanks from said web.

15. A method of providing a dye density gradient to a web comprising a relatively small transverse dimension and top and bottom substantially parallel longitudinal edges, said web providing a lens stock from which lenses can be cut, which method comprises:

conducting said web into a bath of dye material in such a manner that a plane through the longitudinal dimension of said web is substantially perpendicular to the surface of the bath and said bottom longitudinal edge of said web enters said dye bath at a small acute angle to the surface of said dye bath so that the web is at least partially progressively immersed in said dye bath, and conducting said web out of said dye bath whereby a transverse dye density gradient is established on said web as a function of the residence time of the various portions of said web in said dye bath.

16. A method comprising providing a web comprising a transparent synthetic plastic material, said web comprising a relatively large longitudinal dimension and a relatively small transverse dimension and top and bottom substantially parallel longitudinal edges, conducting said web into a bath of dye material in such a manner that the transverse plane through the longitudinal dimension of said web makes a right angle with the plane of the surface of said bath and said bottom longitudinal edge of said web enters said dye bath substantially parallel to the surface of said dye bath so that the web is at least partially progressively immersed in said dye bath, conducting said web out of said dye bath whereby a transverse dye density gradient is established on said web as a function of the residence time of the various portions of said web in said dye bath, washing said web after conducting it out of said dye bath, drying said web, and cutting lens blanks from said web.

* * * * *